United States Patent [19]

Kingsley

[11] 4,134,378

[45] Jan. 16, 1979

[54] BALANCE TUBE FUEL BOWL VENT SYSTEM

[75] Inventor: Charles A. Kingsley, Sterling Heights, Mich.

[73] Assignee: General Motors Corporation, Detroit, Mich.

[21] Appl. No.: 838,648

[22] Filed: Oct. 3, 1977

[51] Int. Cl.[2] ..... F02M 37/00

[52] U.S. Cl. ..... 123/136; 261/DIG. 67

[58] Field of Search ..... 123/136; 261/DIG. 67

[56] References Cited

U.S. PATENT DOCUMENTS

| | | | |
|---|---|---|---|
| 2,839,154 | 6/1958 | Sterner | 123/136 |
| 3,352,294 | 11/1967 | Biller et al. | 123/136 |
| 3,460,522 | 8/1969 | Kittler et al. | 123/136 |
| 3,515,107 | 6/1970 | Joyce | 123/136 |
| 3,575,152 | 4/1971 | Wentworth | 123/136 |
| 3,683,597 | 8/1972 | Beveridge et al. | 123/136 X |
| 3,759,234 | 9/1973 | Buckton et al. | 123/136 |
| 3,782,351 | 1/1974 | Rogerson | 123/136 |
| 3,852,381 | 12/1974 | Mick | 261/150 A |
| 3,884,204 | 5/1975 | Krautwurst | 123/136 |
| 4,016,848 | 4/1977 | Nagai | 123/136 |
| 4,086,897 | 5/1978 | Tamura | 123/136 |

FOREIGN PATENT DOCUMENTS

| | | | |
|---|---|---|---|
| 1434520 | 5/1976 | United Kingdom | 123/136 |

*Primary Examiner*—Carlton R. Croyle
*Assistant Examiner*—Leonard E. Smith
*Attorney, Agent, or Firm*—Arthur N. Krein

[57] ABSTRACT

As part of an evaporative emission control system for an automotive vehicle, the fuel bowl of the carburetor for the internal combustion engine of the vehicle is provided with an internal vent passage for venting fuel vapor from the fuel bowl to the air cleaner, for example, for induction through the induction passage in the carburetor for flow to the engine during engine operation and, with an external vent passage for venting fuel vapor from the fuel bowl to a vapor storage canister when the engine is not in operation, as during hot soak, the internal vent passage having a cross sectional flow area at least two times larger than the minimum cross sectional flow area of the external vent passage whereby changes in pressure at the canister will tend to result in air cleaner depression changes with minimal differential pressures between the carburetor fuel bowl and air cleaner.

3 Claims, 3 Drawing Figures

BALANCE TUBE FUEL BOWL VENT SYSTEM

This invention relates to an evaporative emission control system for an automotive vehicle and, in particular, to a carburetor fuel bowl vapor vent structure for use in such a system.

DESCRIPTION OF THE PRIOR ART

Evaporative emission control systems of various types are presently used in automotive vehicles for controlling the loss of fuel vapor not only from the vehicle fuel tank but also from the fuel bowl of the carburetor for the engine. In one such system, a fuel vapor storage canister containing, for example, activated charcoal is connected to a vapor line from the vehicle fuel tank and to a vapor line from the carburetor fuel bowl for storage of fuel vapor emitted therefrom. During vehicle operation, the fuel vapor is purged from the canister into the engine induction system for combustion within the engine.

Also, in such systems, the float or fuel bowl of the carburetor may be provided with an internal vent line extending upward from the upper part thereof to discharge vapor into the induction passage through the carburetor, as either by opening directly into the induction passage within the carburetor or opening into the clean air side of the usual air cleaner mounted on the carburetor and the fuel bowl is also connected, as by an external vent line, to the vapor storage canister, a suitable flow control valve being positioned between the fuel bowl and the interior of the canister which is operative so as to prevent vapor flow from the fuel bowl to the canister during engine operation while permitting vapor flow to the canister when the engine is not in operation and in particular during the hot soak period after engine shutdown. In another such system, as disclosed for example in U.S. Pat. No. 3,460,522 entitled "Evaporation Control Device-Pressure Balance Valve" issued Aug. 12, 1969 to Milton J. Kittler and P. John Clarke, the external vent line and the so called internal vent line are connected together via a pressure balance valve to a common vent line from the carburetor fuel bowl, the pressure balance valve being operative to vent fuel vapor via the internal vent line into the induction passage in the carburetor during engine operation and via the external vent line to the canister when the engine is not in operation.

SUMMARY OF THE INVENTION

This invention provides a vent system for the fuel bowl of an engine carburetor with a balance tube internal vent and external vent arrangement whereby proper purging of fuel vapor from the fuel bowl occurs via the internal vent during engine operation without appreciable effect on carburetor metering while permitting the external vent to always be in direct flow communication with a vapor storage canister.

Accordingly, a primary object of this invention is to improve an evaporative emission control system and, in particular, to improve the vent structure of a carburetor fuel bowl whereby such vent structure is operative to automatically control vapor flow from the fuel bowl either to the induction passage for the engine during engine operation or to a vapor storage canister when the engine is not in operation thereby eliminating the need for a flow control valve in the system to regulate vapor flow.

In accordance with the invention, the fuel blow of a carburetor for an engine is provided with an external vent that is connected to the vapor storage canister of the evaporative emission control system for the engine and with an internal vent, preferably at least twice the flow area size of the external vent, opening into a portion of the induction passage for the engine.

The details as well as other objects and advantages of this invention are shown in the drawings and are set forth in the detailed description of the embodiments.

Figure 3:
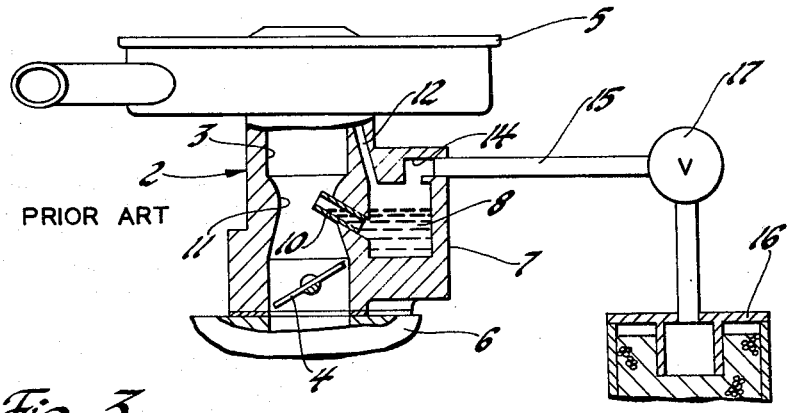

Referring first to FIG. 3, there is illustrated schematically a portion of a conventional prior art evaporative emission control system for a vehicle engine. As shown, the internal combustion engine, not shown, has an induction system including a carburetor 2 having a mixture conduit or induction passage 3 therethrough with flow through the induction passage controlled by a throttle valve 4. A conventional air cleaner 5 is mounted on the carburetor 2. Induction fluid flowing through the induction passage 3 is delivered to an intake manifold 6 used to supply the induction fluid to the combustion chambers, not shown, of the engine. Carburetor 2 has a float or fuel bowl 7 containing fuel 8 that is then drawn during engine operation through a venturi tube or nozzle 10 to a venturi area 11 in the induction passage at a rate determined by the setting of throttle valve 4. Fuel is supplied to the fuel bowl 7 from a fuel tank, not shown, with the level of fuel 8 controlled in a normal manner by a float valve or equivalent means, not shown.

As part of an evaporative emission control system, the fuel bowl 7 of the carburetor is provided with an internal vent passage 12 which extends at one end from the upper end of the fuel bowl 7 above fuel 8 to open at its other end into the induction passage to the engine, as for example, by having its other end opening into the interior of the air cleaner 5 on the clean side of the filter, not shown, therein, whereby fuel vapors from the fuel bowl are delivered directly to the induction fluid flowing to the combustion chambers of the engine for combustion therein. The fuel bowl 7 of carburetor 2 is also provided with an external vent passage 14, also opening at one end into the interior of the fuel bowl at a position above the level of fuel therein, the opposite end of this passage 14 being connected, as by a conduit 15, to a fuel vapor storage canister 16 with flow of fuel vapor through the conduit 15 into the canister 16 being controlled by a suitable bowl vent or flow control valve, generally designated 17, which may, for example, be either solenoid actuated or mechanically actuated as by engine manifold vacuum or throttle movement in a manner whereby flow through the conduit 15 between the fuel bowl 7 and the canister 16 is blocked during engine operation.

The fuel vapor storage canister 16 can be of any suitable type, for example, this canister may be of the type disclosed in U.S. Pat. No. 3,683,597 entitled "Evaporation Loss Control System" issued Aug. 15, 1972 to Thomas R. Beveridge and Ernst L. Ranft, such a canister containing a quantity of fuel vapor absorbing carbon therein. The bottom of this type canister is open to atmosphere so that air may be drawn through the carbon to purge the fuel vapor therefrom during engine operation in a manner as disclosed, for example, in the above identified U.S. Pat. No. 3,683,597.

The particular prior art fuel bowl vent structure shown in FIG. 3 is a series system and is such that during engine operation, assuming no flow control valve 17 in the system, any changes in pressure at the vapor storage canister 16, due to the purge of fuel vapor therefrom, is reflected first in the fuel bowl 7 via external vent passage 14 and then communicated to the air cleaner 5 through the internal vent passage 12. This series effect in conjunction with a relatively small diameter internal vent passage in relation to the flow area of the external vent passage 14 can result in a major change in the carburetor metering. As well known in the carburetor art, the fuel in the fuel bowl of the carburetor should be subjected to a substantially constant metering head, that is, from the substantially atmospheric pressure in the upper portion of the fuel bowl to the generally constant pressure in the induction passage 3 upstream of the throttle valve 4.

Thus, in a carburetor having an internal vent passage, such as the vent passage 12 shown in FIG. 3, the pressure in the fuel bowl 7 above the level of fuel 8 therein should be equalized with that in the mixture conduit or induction passage on the air inlet side of the carburetor, as is usually required for accurate fuel metering. Thus, again referring to FIG. 3, in order to insure that the curburetor metering will not be affected by extraneous pressures which might differ from the air cleaner depression, a suitable flow control valve 17 has normally been used in the prior art systems of this type, with such a flow control valve being suitably positioned in the system as shown between the canister 16 and the external vent passage 14 from the fuel bowl.

In one particular prior art system, the flow control valve 17 is actuated by engine manifold vacuum and the valve 17 is constructed so that it will close flow through the external vent passage at all vacuum signals above ½ inch Hg and be open for flow below this level, in essence at an engine off condition. With such an arrangement, during engine operation, fuel vapor emitted from the fuel bowl will be vented into the engine induction system for flow to the engine and consumption therein and, when the engine is not operating, fuel vapor expelled from the fuel bowl, especially during hot soak, will flow to the vapor storage canister 16 for storage therein. Accordingly, during engine operation, a pressure balance is maintained between the interior of the fuel bowl 7 above the level of liquid fuel therein and the inlet side of the induction passage 3 through the carburetor 2, since the flow control valve 17 would be closed thereby blocking flow through the external vent passage 14.

It will be apparent to those skilled in the art that the vent structure with pressure balance valve shown in the above identified U.S. Pat. No. 3,460,522 is also operative in a manner similar to that described above during engine operation whereby to maintain a pressure balance between the fuel bowl and the inlet side of the carburetor to maintain proper carburetor metering.

Now, in accordance with the invention, it has been found that proper pressure balance can be maintained in a carburetor fuel bowl, having a vent system as part of an evaporative emission control system, without the need for a flow control valve in the system between the carburetor fuel bowl and the canister. This is obtained in accordance with the invention by proper sizing of the internal vent passage relative to the external vent passage and by not placing these vents in series relationship with the carburetor fuel bowl.

Figure 1:
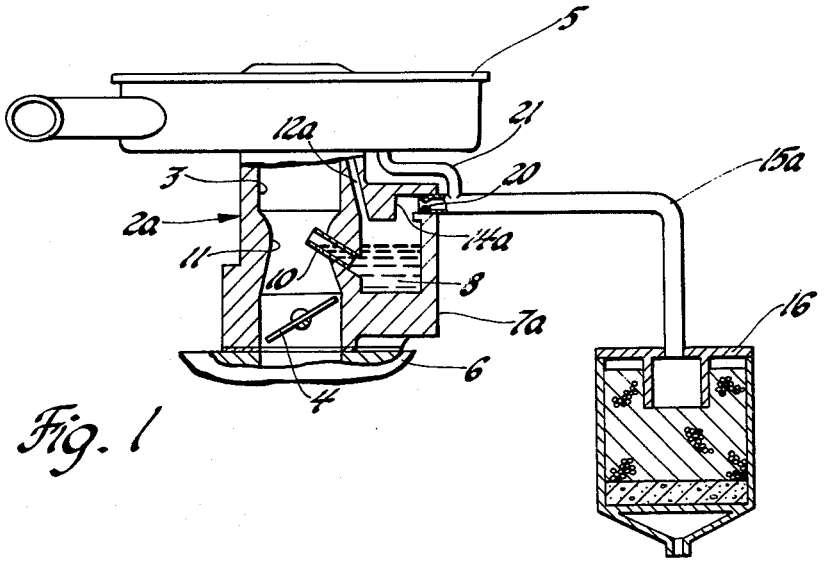
FIG. 1 is a schematic side view, partly in section, of a portion of an evaporative emission control system for a vehicle engine, the system having incorporated therein a preferred embodiment of a balance tube fuel bowl vent system in accordance with the invention.

Referring now to FIG. 1, there is illustrated a preferred embodiment of a balance tube fuel bowl vent system in accordance with the invention, elements similar to those previously described with reference to FIG. 3 being designated by similar numerals but with the addition of a suffix. In the preferred embodiment shown in FIG. 1, the space above the level of fuel 8 in the fuel bowl 7*a* of the carburetor 2*a* is vented by an internal vent passage 12*a*, of a predetermined flow area in cross section, that opens from the upper end of the fuel bowl 7*a* and extends to discharge fuel vapor into the air cleaner 5 on the clean side of the air filter, not shown, therein. It is to be realized, of course, that this internal vent passage 12*a*, could open directly into the induction passage 3*a* of the carburetor at the inlet end thereof.

The fuel bowl 7*a* is also provided with an external vent passage 14*a* having an orifice restriction 20 therein of a predetermined diameter relative to the flow area of the internal vent passage 12*a*, as described in detail hereinafter, the external vent passage 14*a* being connected by the conduit 15*a* to the vapor storage canister 16. In addition, the external vent passage 14*a* is connected by a branch conduit 21 to the interior of the air cleaner on the clean side of the air filter therein, the branch conduit 21, for example, being connected to the conduit 15*a* between the orifice restriction 20 and the canister 16.

In accordance with the invention, the minimum cross sectional flow area of the internal vent passage 12*a* should be at least two and preferably three or more times greater than the minimum cross sectional flow area of the external vent passage 14*a*, that is, of the cross sectional flow area through the orifice restriction 20 in this embodiment. Preferably the internal vent passage to external vent passage flow area ratio should be 3:1 or greater to prevent excess enrichment of the desired air fuel ratio.

It will now be readily apparent to those skilled in the art that the greater the internal vent passage to external vent passage flow ratio, the closer this ratio approaches ∞ [infinity]. A ratio of ∞ [infinity] would in effect correspond to an external vent closed position as obtained in the prior art by the use of a flow control valve, such as valve 17 of FIG. 3, which is operative to close the external vent passage during engine operation. Test results have indicated that internal to external flow area ratios in the order of 3:1, 4:1, and 6:1, obtainable by using normal size conduit hoses as part of the conduit 15*a* for the interconnection between the fuel bowl, the external vent passage 14*a* and the canister 16 prevent excess enrichment of the calibrated air fuel ratio.

On the other hand reducing the internal to external flow area ratios below 3:1, to say, for example, 2:1 or lower will result in increased enrichment of the air fuel ratio during engine operation as compared to the use of at least a 3:1 ratio but, such lower flow area ratio may be used depending on other factors for a given engine application. However, with increased emphasis on the desirability for controlling engine emissions, it should be apparent that close control of carburetor metering is highly desirable, and accordingly, emphasis has been made herein to the desirability of having the internal to external vent flow ratio preferably 3:1 or higher.

Thus for a particular engine, carburetor 2*a* and canister 16 combination, the internal vent passage to external vent passage flow area ratio should be selected so that changes in pressure within the canister 16 during engine operation will and not result in air cleaner 5 depression changes with minimal differential pressure between the carburetor fuel bowl 7 and the air cleaner or air inlet side of the carburetor. In this regard it should be noted that improvement in controlling carburetor metering in accordance with the teaching of this invention by increasing the internal vent passage to external vent passage flow area ratio is not a linear function with respect to the venting ratio.

Figure 2:
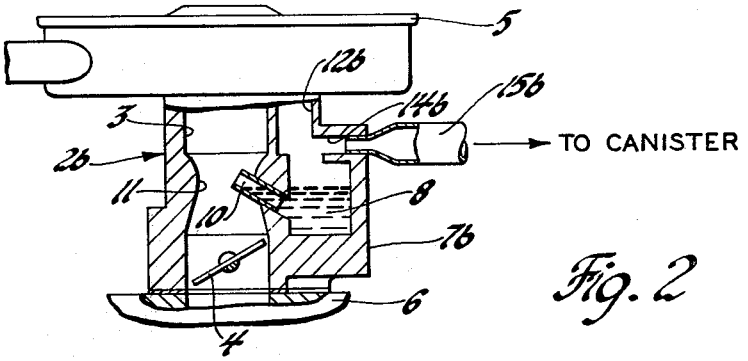
FIG. 2 is a schematic side view, partly in section, of an alternate embodiment of a balance tube fuel bowl vent system in accordance with the invention; and, FIG. 3 is a view, similar to FIG. 1, of a portion of an evaporative emission control system having incorporated therein a prior art type carburetor fuel bowl vent system with a conventional flow control valve for controlling vapor flow.

Referring now to the alternate embodiment of the balance tube fuel bowl vent system shown in FIG. 2, the space above the level of fuel 8 in the fuel bowl 7*b* of the carburetor 2*b* in this Figure is vented by an internal vent passage 12*b*, of somewhat L-shaped in cross section and of a predetermined flow area that opens from the upper end of the fuel bowl 7*b* and extends to discharge fuel vapor into, for example, the air cleaner 5 on the clean side of the air filter, not shown, therein. The fuel bowl 7*b* is also provided with an external vent passage 14*b* that intersects the internal vent passage 12*b* intermediate the ends thereof, the external vent passage 14*b* being connected by a conduit 15*b* directly to the canister 16 in a manner similar to that schematically illustrated in FIG. 1. In this embodiment the minimum cross sectional flow area of the external vent passage 14*b* is of a predetermined reduced size relative to the cross sectional flow area of the internal vent passage 12*b* whereby the internal to external flow area ratio of this passage is at least 2:1 and preferably 3:1 or larger for the reasons previously described in detail above.

The operation of the alternate embodiment of the vent system of FIG. 2 is the same as that of the embodiment of FIG. 1 in that, changes in pressure at the canister 16 will tend to result in air cleaner 5 depression change with minimal differential pressure between the fuel bowl of the carburetor and the interior of the air cleaner due to the large size of the internal vent passage 12*b* as compared to the external vent passage 14*b*.

What is claimed is:

1. A carburetor for an internal combustion engine, said carburetor having a carburetor body with an induction passage therethrough including a venturi, a fuel bowl, a nozzle in the venturi of said carburetor body in fluid communication with said fuel bowl, an air cleaner disposed at the inlet end of said induction passage in said carburetor body, an internal vent passage extending upward from the upper part of said fuel bowl to a position in said air cleaner adjacent to the inlet end of said induction passage for venting fuel vapor from said fuel bowl into the inlet end of said induction passage through said carburetor during engine operation and, an always open external vent passage extending from the upper part of said fuel bowl and being connectable to a vapor storage canister and being in flow communication with said air cleaner adjacent to the said inlet end of said induction passage, said internal vent passage having a cross sectional flow area greater than two times larger than the minimum cross sectional flow area of said external vent passage whereby changes in pressure in the vapor storage canister will tend to result in air cleaner depression changes with minimal differential pressure between said fuel bowl and said air cleaner.

2. A carburetor according to claim 1 wherein said internal vent passage and said external vent passage have a common inlet end extending from said fuel bowl.

3. A carburetor according to claim 1 wherein said external vent passage includes a branch passage in flow communication with said air cleaner adjacent to the inlet end of said induction passage and an orifice passage portion located between said fuel bowl and said branch passage, said internal vent passage having a cross sectional flow area at least substantially two times greater than the flow area through said orifice passage portion.

* * * * *